US009408290B2

(12) United States Patent
Douglas et al.

(10) Patent No.: US 9,408,290 B2
(45) Date of Patent: Aug. 2, 2016

(54) METHOD AND APPARATUS FOR RECIRCULATION WITH CONTROL OF SYNCHROTRON RADIATION

(71) Applicant: JEFFERSON SCIENCE ASSOCIATES, LLC, Newport News, VA (US)

(72) Inventors: David R. Douglas, Yorktown, VA (US); Christopher Tennant, Williamsburg, VA (US)

(73) Assignee: JEFFERSON SCIENCE ASSOCIATES, LLC, Newport News, VA (US)

( * ) Notice: Subject to any disclaimer, the term of this patent is extended or adjusted under 35 U.S.C. 154(b) by 16 days.

(21) Appl. No.: 14/526,597

(22) Filed: Oct. 29, 2014

(65) Prior Publication Data

US 2015/0221467 A1 Aug. 6, 2015

Related U.S. Application Data

(60) Provisional application No. 61/910,307, filed on Nov. 30, 2013.

(51) Int. Cl.
*H01J 29/56* (2006.01)
*H05H 13/04* (2006.01)
*H05H 7/00* (2006.01)

(52) U.S. Cl.
CPC ..... *H05H 13/04* (2013.01); *H05H 2007/005* (2013.01)

(58) Field of Classification Search
CPC ..... H05H 13/04
See application file for complete search history.

(56) References Cited

U.S. PATENT DOCUMENTS

| | | | | |
|---|---|---|---|---|
| 5,285,166 | A * | 2/1994 | Hiramoto | H05H 7/10 315/504 |
| 8,217,596 | B1 * | 7/2012 | Douglas | H01S 3/0903 250/492.3 |
| 2008/0290297 | A1 * | 11/2008 | Blasche | A61N 5/1078 250/492.3 |
| 2015/0228444 | A1 * | 8/2015 | Douglas | H01J 37/147 250/396 R |

OTHER PUBLICATIONS

Sun, "A second-order achromat design based on FODO Cell". Jul. 12, 2011.*

Di Mitri, S. et al., Cancellation of Coherent Synchrotron Radiation Kicks with Optical Balance, Jan. 2, 2013, pp. 1-4, vol. 110, No. 014801, Physical Review Letters, US.

Valloni, A et al., Strawman Optics Design for the LHeC ERL Test Facility, May 2013, pp. 1694-1696, vol. TUPME055, Proceedings IPAC 2013, Shanghai, China.

* cited by examiner

*Primary Examiner* — Michael Logie

(57) ABSTRACT

A method for controlling beam quality degradation from ISR and CSR and stabilizing the microbunching instability (μBI) in a high brightness electron beam. The method includes providing a super-periodic second order achromat line with each super period being individually linearly achromatic and isochronous, setting individual superperiod tunes to rational fractions of an integer (such as $4^{th}$ or $6^{th}$ integers), setting individual bend angles to be as small as practical to reduce driving terms due to dispersion and dispersive angle, and setting bend radii as large enough to suppress ISR but not negatively affect the radial dependence of CSR. The method includes setting the structure of the individual superperiods to minimize bend plane beam envelope values in the dipoles to reduce betatron response to a CSR event at a dispersed location, increasing beam angular divergence, and creating dispersion nodes in the dipoles to similarly reduce response to CSR events, and limit $R_{56}$ modulation in order to mitigate μBI.

2 Claims, 10 Drawing Sheets

METHOD AND APPARATUS FOR RECIRCULATION WITH CONTROL OF SYNCHROTRON RADIATION

This application claims the priority of Provisional U.S. Patent Application Ser. No. 61/910,307 filed Nov. 30, 2013.

The United States Government may have certain rights to this invention under Management and Operating Contract No. DE-AC05-06OR23177 from the Department of Energy.

FIELD OF THE INVENTION

The present invention relates to recirculating electron linear accelerators and more particularly to a method and apparatus a method for controlling beam quality degradation from ISR and CSR and stabilizing the microbunching instability in a high brightness electron beam.

BACKGROUND OF THE INVENTION

Numerous recent proposals such as JLAMP (JLab AMPlifier), a 4th generation light source covering the range 10 eV-100 eV in the fundamental mode with harmonics to 1 keV, and the LHeC (Large Hadron Electron Collider). Test ERL have invoked recirculation and energy recovery as a means of cost-performance optimization. Beam line designs for such systems are difficult to design and implement because of the beam-quality-degrading effects of both incoherent synchrotron radiation (ISR) and coherent synchrotron radiation (CSR).

Incoherent synchrotron-radiation-driven degradation of beam quality during transport and recirculation imposes severe limitations in the design of high-brightness electron accelerator systems. Methods for its control are well established. Methods for control of CSR and the microbunching instability (μBI) are less well established. In the following, we describe an effective means for simultaneous control of ISR, CSR and microbunching.

What is needed is a method and apparatus for control of, and for reducing beam quality degradation from ISR and CSR and which stabilizes the microbunching instability.

OBJECT OF THE INVENTION

It is therefore an object of the present invention to provide a method and apparatus a method for controlling beam quality degradation from ISR and CSR and stabilizing the microbunching instability in a high brightness electron beam.

SUMMARY OF THE INVENTION

According to the present invention there is provided a method for controlling beam quality degradation from ISR and CSR and stabilizing the microbunching instability in a high brightness electron beam. The method includes providing a super-periodic second order achromat line with each superperiod being individually linearly achromatic and isochronous, setting individual superperiod tunes to rational fractions of an integer (such as $4^{th}$ or $6^{th}$ integers), setting individual bend angles as small as practical to reduce driving terms due to dispersion and dispersive angle, and setting bend radii large enough to suppress ISR while limiting the bend radii so that the radial dependence of CSR is not aggravated. The method includes setting the structure of the individual superperiods to minimize bend plane beam envelope values in the dipoles to reduce betatron response to a CSR event at a dispersed location, increasing beam angular divergence to reduce the relative size of the angular error associated with a CSR event at a location of nonzero dispersive angle, and creating dispersion nodes in the dipoles to similarly reduce response to CSR events, and limit $R_{56}$ modulation in order to mitigate the μBI.

DETAILED DESCRIPTION

Figure 1:
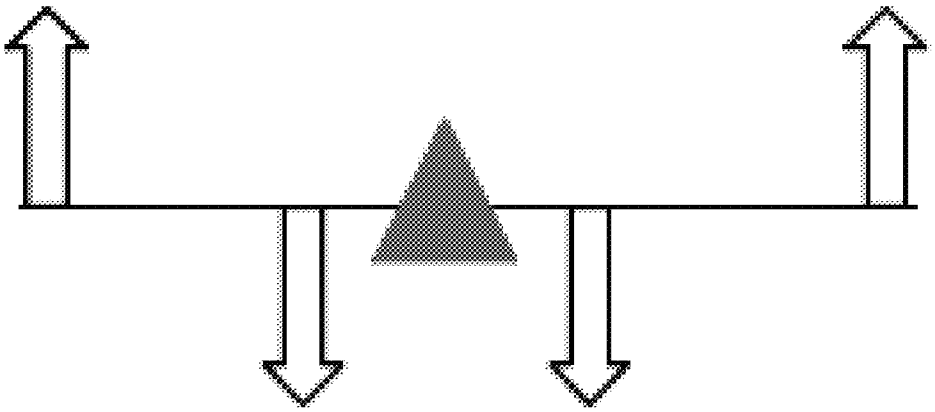
FIG. 1 is a block diagram of a theoretical minimum emittance (TME) cell, which serves as the building block for an example apparatus based on the method described herein.

The current invention is a method and apparatus for controlling and reducing beam quality degradation from incoherent synchrotron radiation and coherent synchrotron radiation while stabilizing the microbunching instability.

The method includes utilizing superperiodic recirculation transport with phasing as in a second order achromat, with individually isochronous and achromatic superperiods. Each superperiod is to be built up out of low-quantum-excitation periods of types familiar to those skilled in the art, such as three-bend achromats (TBA), Chasman-Green (two-bend) achromats, flexible-momentum-compaction (FMC) arc cells, or theoretical-minimum-emittance cells (TME). Modulation of focusing, choice of betatron phase advance, dispersion modulation, or other means can then be used to render individual superperiods achromatic and isochronous. Use of such low excitation lattices and choice of sufficiently large bend radius then insures ISR effects are well-managed.

When combined into a complete recirculation arc, the resulting system is achromatic, isochronous, and can be readily aberration-corrected through methods such as implementation of second- or higher-order achromaticity using sextupoles, octupoles, or higher-order nonlinear elements. The choice of betatron phase relationships, such as those for a second order achromat, then insures that CSR effects on emittance are automatically compensated. In addition, the use of multiple isochronous periods insures that excursions of momentum compaction ($R_{56}$) along the beam line are modest, which in turn has been demonstrated in simulation to stabilize microbunching effects up to very high charge.

In maintaining the brightness of an electron beam, it is further advantageous to control beam quality degradation from CSR. Emittance compensation of CSR-driven degradation has been proposed by S. Di Mitri, M. Cornacchia, and S. Spampinati in "Cancellation of Coherent Synchrotron Radiation Kicks with Optics Balance", Phys. Rev. Lett. 110, 014801, 2 Jan. 2013. The emittance compensation includes appropriate choices of lattice symmetry, periodicity, and betatron phasing to suppress CSR-induced phase space distortion.

Sufficient requirements for an emittance compensation of this type are readily met by a periodic second-order achromat with individually achromatic and isochronous superperiods as this insures: 1) each dipole has a partner dipole a half-betatron wavelength away (in the bending plane), 2) Twiss $\beta$, dispersion, and dispersion slope are the same at each dipole, and 3) the bunch length is the same at both dipoles in a phase-homologous pair.

Provided that the impact of CSR in any single dipole is not excessively large, first-order radiatively-induced perturbations are then compensated in the same way that the lowest-order chromatic and geometric aberrations are cancelled while traversing the achromat. The need to keep the effect of individual perturbations modest places limits on several parameters, including 1) the maximum tolerable bend radius, 2) the maximum tolerable bend angle, 3) the maximum tolerable Twiss $\beta$ and $\eta$ and $\eta'$ in the dipole, and 4) the minimum transportable bunch length.

The specific choice of lattice cell/superperiod length, achromat phasing/periodicity, and the impact of chromatic and geometric aberrations also influence the details of any design, as do any requirements for nonlinear compaction control, and the manner in which the arc transport is to be integrated with any intermediate stages of bunch compression to be employed in the longitudinal match. The use of individually achromatic and isochronous superperiods is particularly useful in this case, as the $R_{56}$ contribution from any single dipole will tend to be small. Achromaticity requires that initial and final dipoles are at locations of zero dispersion; isochronicity then constrains the dispersion to be similarly small at dipoles in the interior of the superperiod, provided that either reversed bending or very large modulation of dispersion is avoided, though both reversed bending and dispersion modulation are also tolerable for many ranges of parameters for which this invention is applicable.

With regard to stabilizing the microbunching instability in a high brightness electron beam, it is proposed that limitation in the magnitude of $R_{56}$ will in at least some cases suppress the instability gain. Use of an isochronous arc in which individual dipoles are both small angle and have small dispersion functions, and thus contribute little to either the magnitude or modulation of $R_{56}$, may thus mitigate this instability.

In addition, there is mitigation of $\mu$BI by use of positive compaction compression after accelerating on the falling side of the RF waveform. This can avoid all parasitic compressions, most critically perhaps the one occurring in the next-to-last dipole of any negative compaction compressor, such as a chicane, where the bunch, if fully compressed at the end of the chicane, will necessarily, as a result of the positive $R_{56}$ of the final dipole, be over-compressed. This leads to significant CSR production which can forward-propagate and in principle interact with the short, over-compressed bunch as it drifts to the final dipole.

Such degradation is avoided altogether if positive compaction is used, as the bunch length monotonically decreases throughout the compressor and no parasitic crossovers (with associated strong emission of CSR) occur. The following analysis therefore assumes this type of compression. As a consequence, acceleration will be on the falling side of the RF waveform, and the temporally earlier part of the bunch will be at higher energy than the tail.

Thus a method of controlling incoherent synchrotron radiation (ISR) coherent synchrotron radiation (CSR), and the microbunching instability in a high brightness electron beam should include the following:

1) providing a super-periodic second order achromat line with each super period being individually linearly achromatic and isochronous;
2) setting individual superperiod tunes to rational fractions of an integer (such as $4^{th}$ or $6^{th}$ integers);
3) setting individual bend angles as small as practical to reduce driving terms due to dispersion and dispersive angle;
4) setting bend radii as large enough to suppress ISR while limiting the bend radii to limit the radial dependence of CSR;
5) setting the structure of the individual superperiods to
   a) minimize bend plane beam envelope values in the dipoles to reduce betatron response to a CSR event at a dispersed location;
   b) increase beam angular divergence, thus reducing the relative size of the angular error associated with a CSR event at a location of nonzero dispersive angle;
   c) create dispersion nodes in the dipoles to similarly reduce response to CSR events, and limit $R_{56}$ modulation in order to mitigate the $\mu$BI.

The choice of tune/periodicity and focusing structure should admit—in addition to aberration suppression via second-order achromaticity—means of control of nonlinear momentum compaction, in particular $T_{566}$ and $W_{5666}$.

Figure 2:
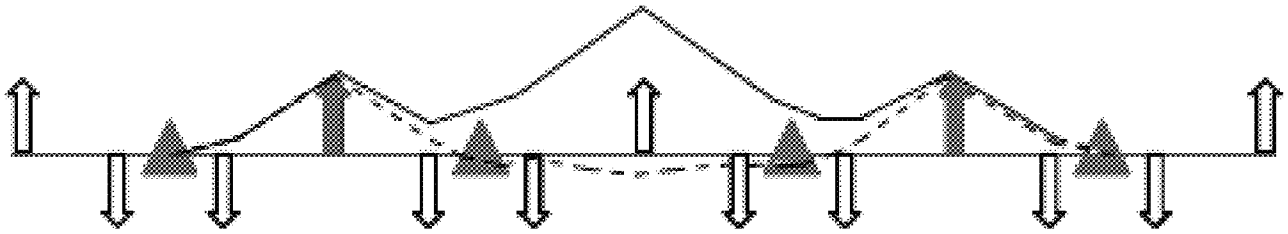
FIG. 2 is a block diagram of a superperiod of a beam line using the method under discussion to control ISR, CSR, and microbunching. It consists of four TME cells. The notional dispersion pattern for a tuning as identical 90° cells is displayed as a solid line. When the shaded quadrupole focusing magnets are increased in strength to make the overall superperiod a rational-tune isochronous achromat, the dispersion is shown as a dashed line.

Example Beam-Line Design Generating Little or no Beam Quality Degradation During Recirculation All requirements for this method can be met by a second-order achromat based on superperiods built out of four or more TME cells (FIG. 1). As a validation of the method, we have designed a specific example and evaluated its performance using standard analyses and tools. In this example four TME cells with 90° (quarter-integer) tune and with bend angle 7.5° are combined to form a single superperiod (FIG. 2). The modest bend angle was chosen to keep the cell short and thereby provide control of lattice functions to reduce both ISR and CSR effects. By virtue of the choice of tune, the superperiod is achromatic, with the dispersion shown as a solid line in FIG. 2. It is not, however, isochronous.

To make it isochronous, the shaded quadrupole pair—which quads are separated by 180° in betatron phase by virtue of the single cell tune—is increased in strength until the dispersion pattern resembles that represented by the dashed line. As the dispersion is driven down in the inner dipoles, the tunes split, and a linearly achromatic, isochronous superperiod obtained. Optimization using all quad families then allows choice of tune, matched envelopes, enforced achromaticity, and selection of momentum compaction.

After numerical analysis and optimization, we find that sixth-integer tunes (7/6 horizontal, 5/6 vertical) provide good chromatic behavior and admits a particularly simple means of control of $T_{566}$ (and in principle $W_{5666}$), as discussed below. Six superperiods then form a second-order achromatic arc segment subtending a full bend angle of 90°; two such structures provide a full 180° arc that can be used for recirculation.

The betatron phasing associated with the second order achromat architecture also introduces emittance compensation in the manner discussed above: each dipole has a partner a half-betatron-wavelength away, at which the bunch length and all beam envelope functions are the same, so that emittance-degrading effects cancel. This is particularly strongly enforced by use of a periodically isochronous structure—which insures that the bunch length is the same at betatron phase-homologous CSR emission sites.

Figure 3:
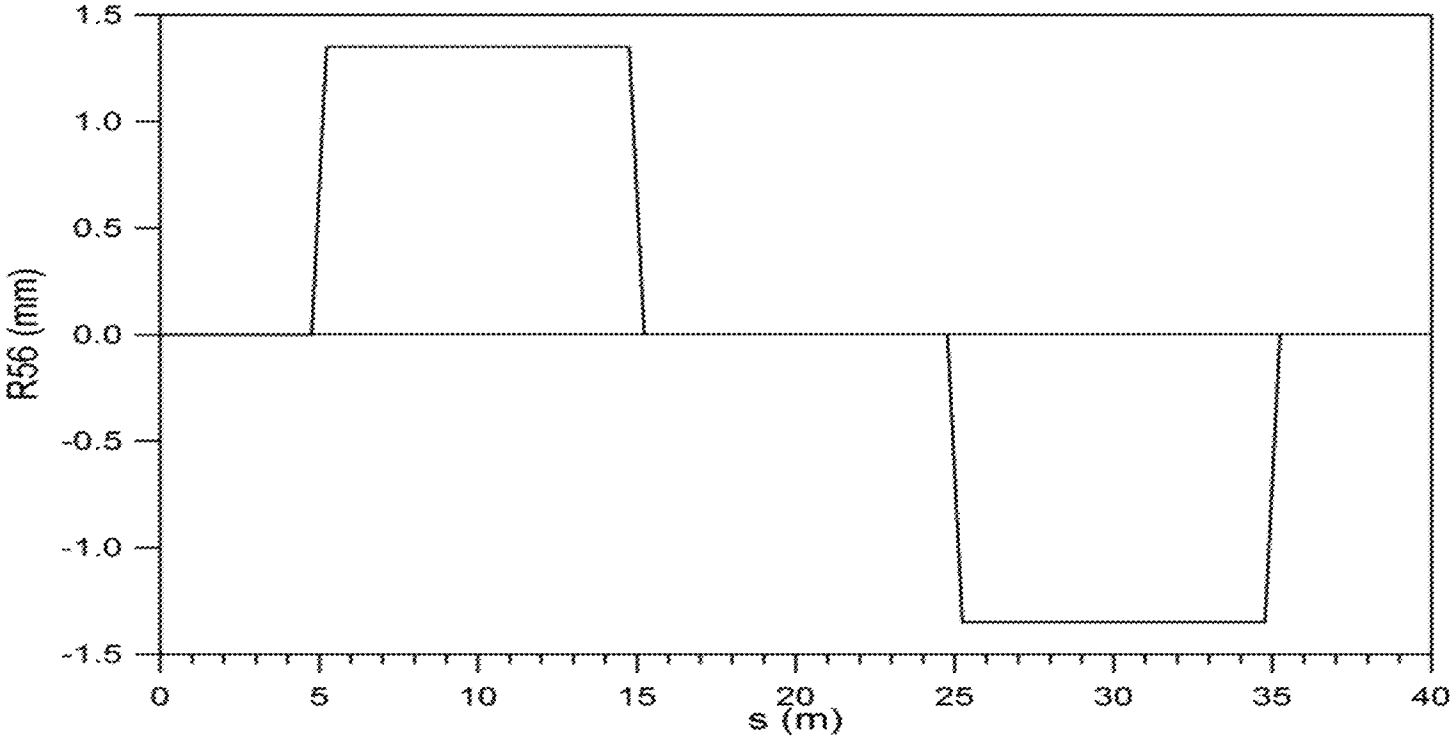
FIG. 3 depicts the evolution of $R_{56}$ through a single superperiod.

The small dispersion and dispersive slope result not only in a small (zero) momentum compaction in each superperiod, the modulation of the momentum compaction through the system is extremely small, potentially providing some limitation on microbunching gain. FIG. 3 shows the evolution of $R_{56}$ through a superperiod; max/min values are at the millimeter level.

Chromatic correction is—as in conventional systems—intended to control emittance degradation due to aberrations, assist in instability management, and alleviate sensitivity to machine/beam energy drifts. In this case, it is also intended to support control of the beam longitudinal phase space via an appropriate longitudinal match.

Figure 4:
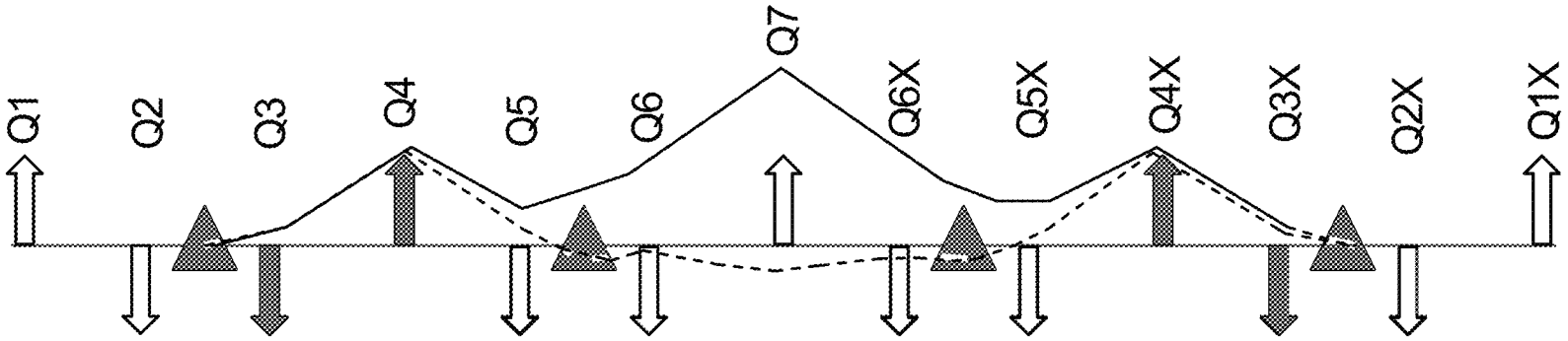
FIG. 4 is a block diagram showing the nomenclature for chromatic correction. Sextupole components in shaded elements are used for correction; Q7 provides $T_{566}$ control, Q3/Q3X and Q4/Q4X correct chromaticity.

We have adopted a simple solution in which one family of sextupoles is adjusted to generate a nonlinear dispersion bump—creating a desired value for $T_{566}$ (in this case, about 5 m); two other families are then set to render the entire arc a second order achromat. FIG. 4 presents nomenclature for the quadrupole/sextupole families that are used. Various combinations of families (with and without reflective symmetry) were tested until a solution with the required performance was obtained. Q7 provides the nonlinear dispersion bump and is manually adjusted to provide a trial solution; sextupole components in Q3/Q3X and Q4/Q4X are then set (by numerical optimization) to zero the horizontal and vertical chromaticities of the superperiod. This process was iterated until an optimum setting for Q7 providing the desired $T_{566}$ value was obtained. All elements in the resulting second order transformation matrix are thus zero, save for the deliberate offset in $T_{566}$.

Overall performance with respect to aberrations is thus quite good, especially for such a simple system. Additional control can—at least in principle—be imposed through use of higher order correction elements such as octupoles or decapoles, but even the simple solutions presented above provide beam quality preservation adequate to perform an analysis of the impact of synchrotron radiation effects.

Preliminary analysis of incoherent synchrotron radiation effects was conducted assuming parameters associated with notional use in XFEL driver applications, with a bunch of charge 300 pC having transverse normalized emittance of 0.25 mm-mrad, corresponding to a geometric value of $9.83\times10^{-11}$ m-rad at 1.3 GeV. The longitudinal emittance is taken to be about 33 keV-psec.

The impact of ISR is readily estimated by those skilled in the art, given the bend radius $\rho=3.614$ m and calculated properties of the magnetic lattice, including the quantum excitation function value $\langle H\rangle=0.045$ m. These result in an excitation-driven growth in relative momentum spread of $\sigma^{E/E}=6.1\times10^{-6}$ and an emittance growth of $\Delta\epsilon=8.3\times10^{-13}$ m-rad, which are quite small. The relative growth in emittance is less than 1% of the assumed transverse value. If we assume an rms bunch length of 3 psec, the longitudinal emittance dictates that the unperturbed rms energy spread will be ~11 keV, a relative value of $\sim8.5\times10^{-6}$. If the $6.1\times10^{-6}$ energy spread resulting from ISR is added in quadrature to this, the result is $(8.5^2+6.1^2)^{1/2}\times10^{-6}\sim1.05\times10^{-5}$—or about a 24% increase. CSR simulations (results given below) indicate that it is possible to increases the bend radius, so further reduction of ISR-driven growth in momentum spread can achieved.

Energy loss to ISR is similarly readily estimated for 180° of bending at this energy and radius and found to be $\Delta\epsilon=0.000035$ GeV, a relative loss of $2.7\times10^{-5}$. Numerical simulations of ISR effects are entirely consistent with all these estimates.

Figure 5:
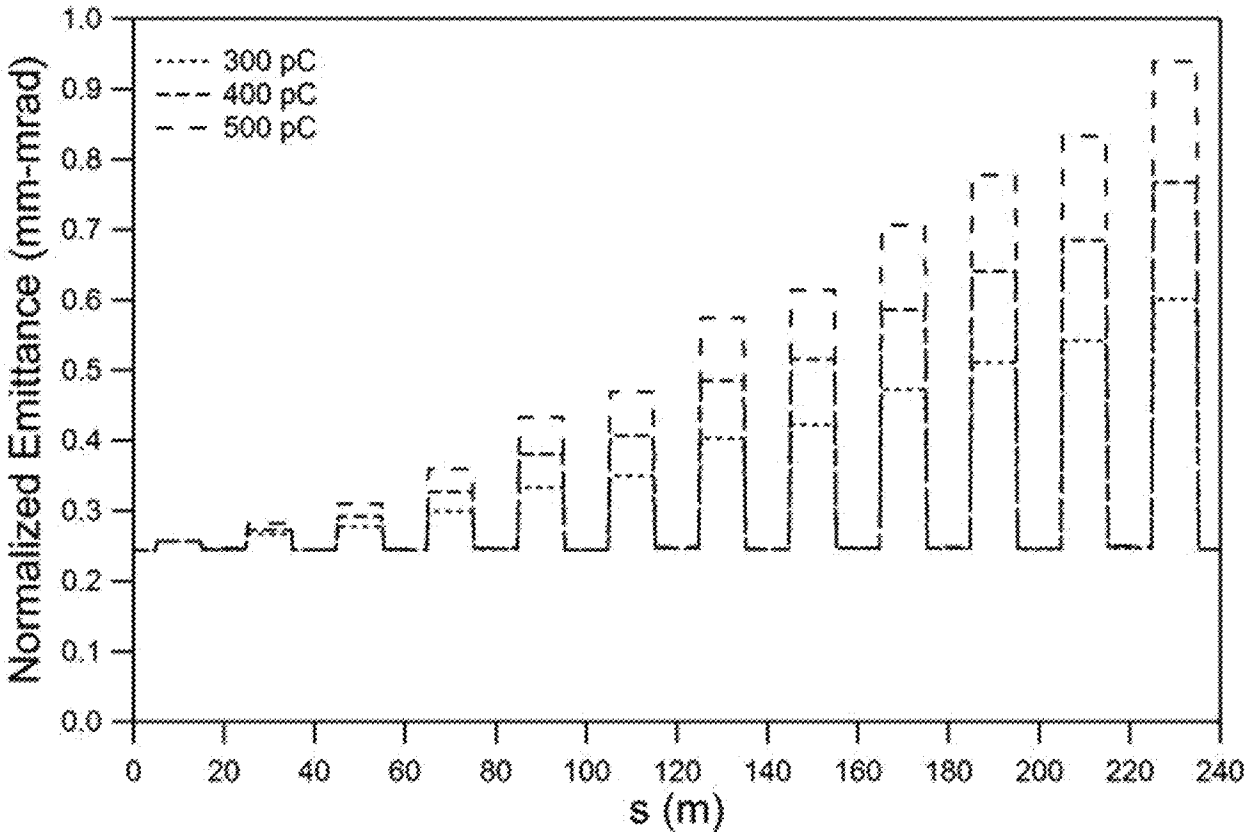
FIG. 5 gives results of numerical simulation of the evolution of emittance at 1.3 GeV through the example transport system for a beam with an initial rms normalized transverse emittance of 0.25 mm-mrad, and 33 keV-psec initial rms longitudinal emittance (at 3 psec rms bunch length), at bunch charges of 300, 400, and 500 pC FIG. 6 summarizes results of simulation of energy loss due to CSR, depicting a plot of the centroid relative energy loss of a 300 pC bunch to CSR as a function of distance through the example system.
Figure 6:
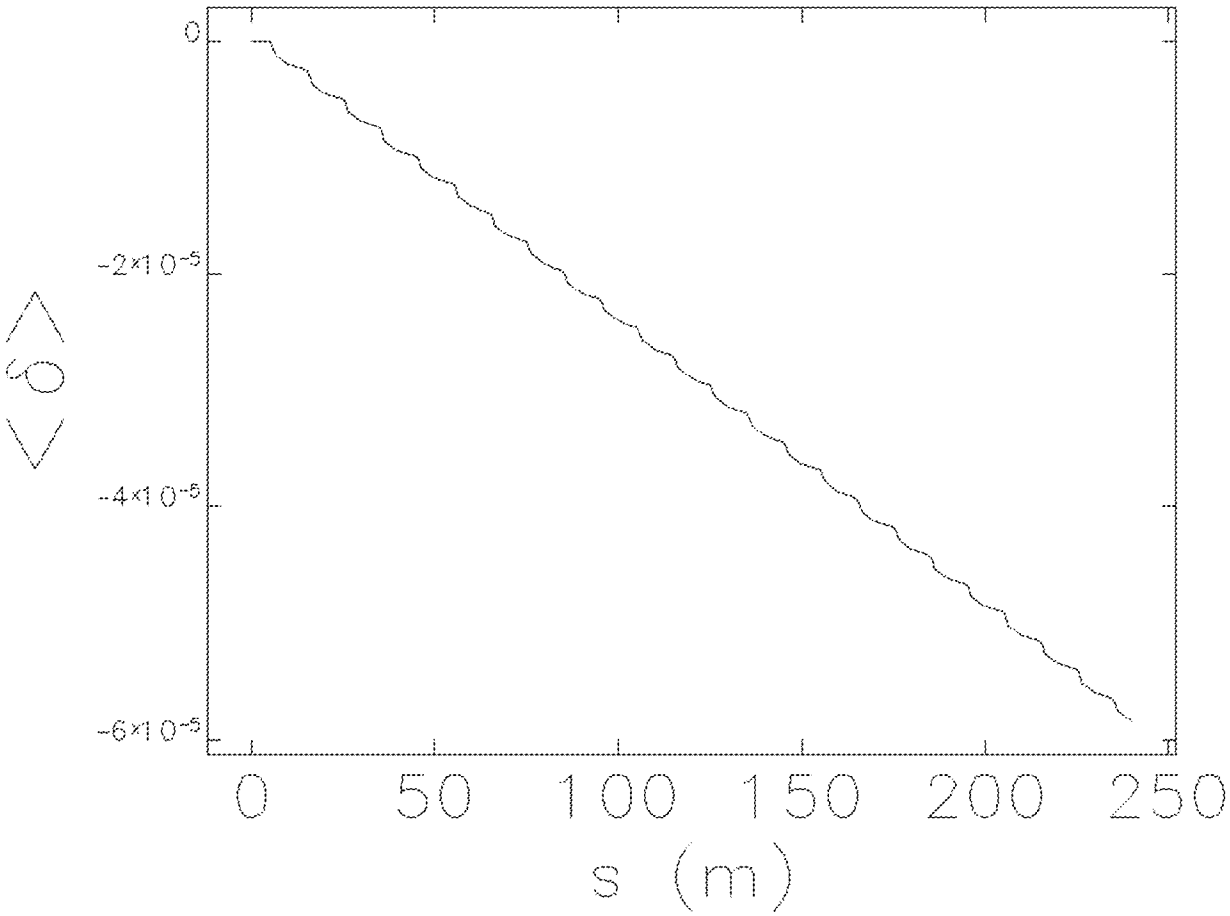
Figure 7:
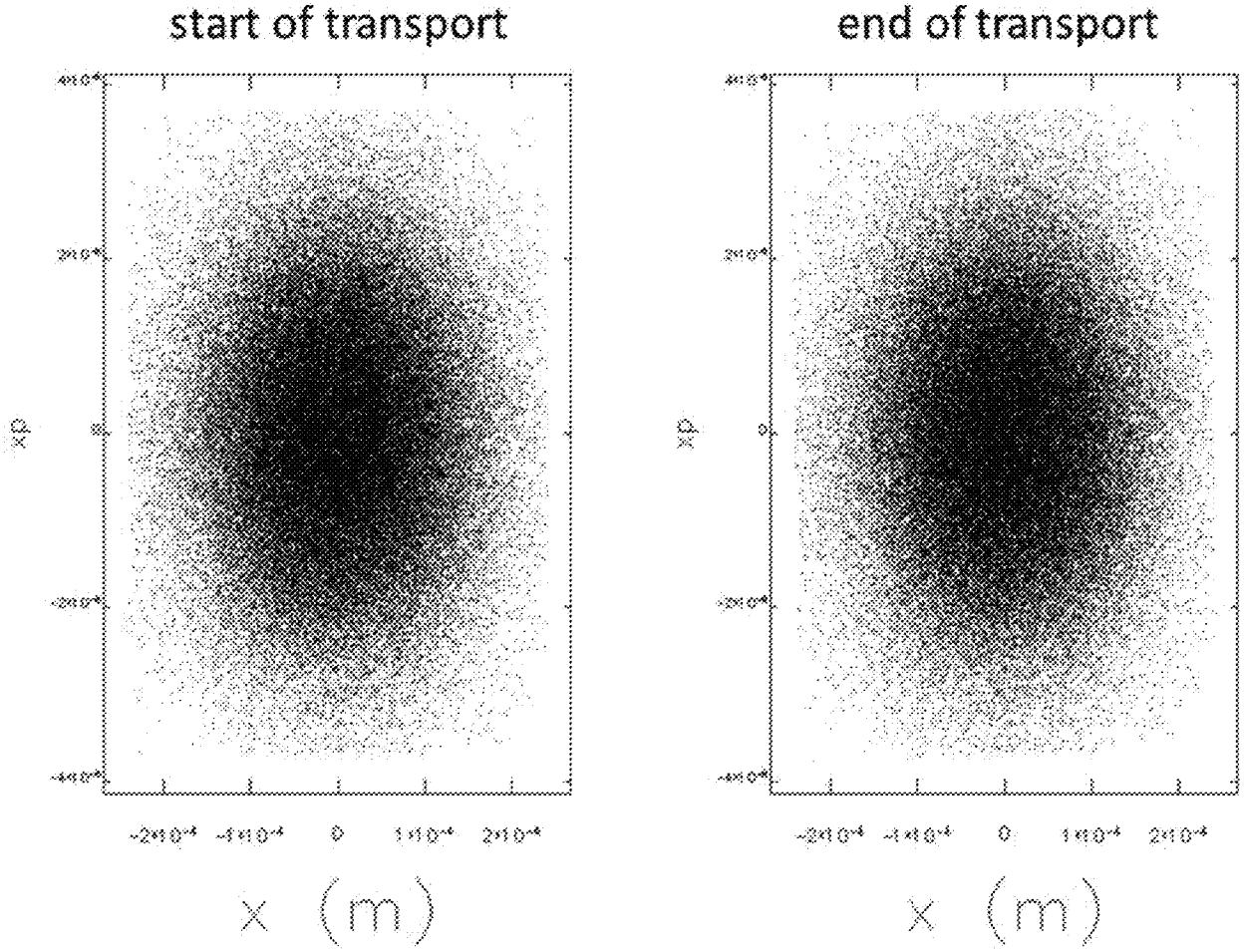
FIG. 7 presents the horizontal (bend) plane phase space for a 300 pC beam with 0.25 mm-mrad initial rms normalized emittance and 33 keV-psec initial rms longitudinal emittance (at 3 psec rms bunch length) before (left) and after (right) transport through the example arc.
Figure 8:
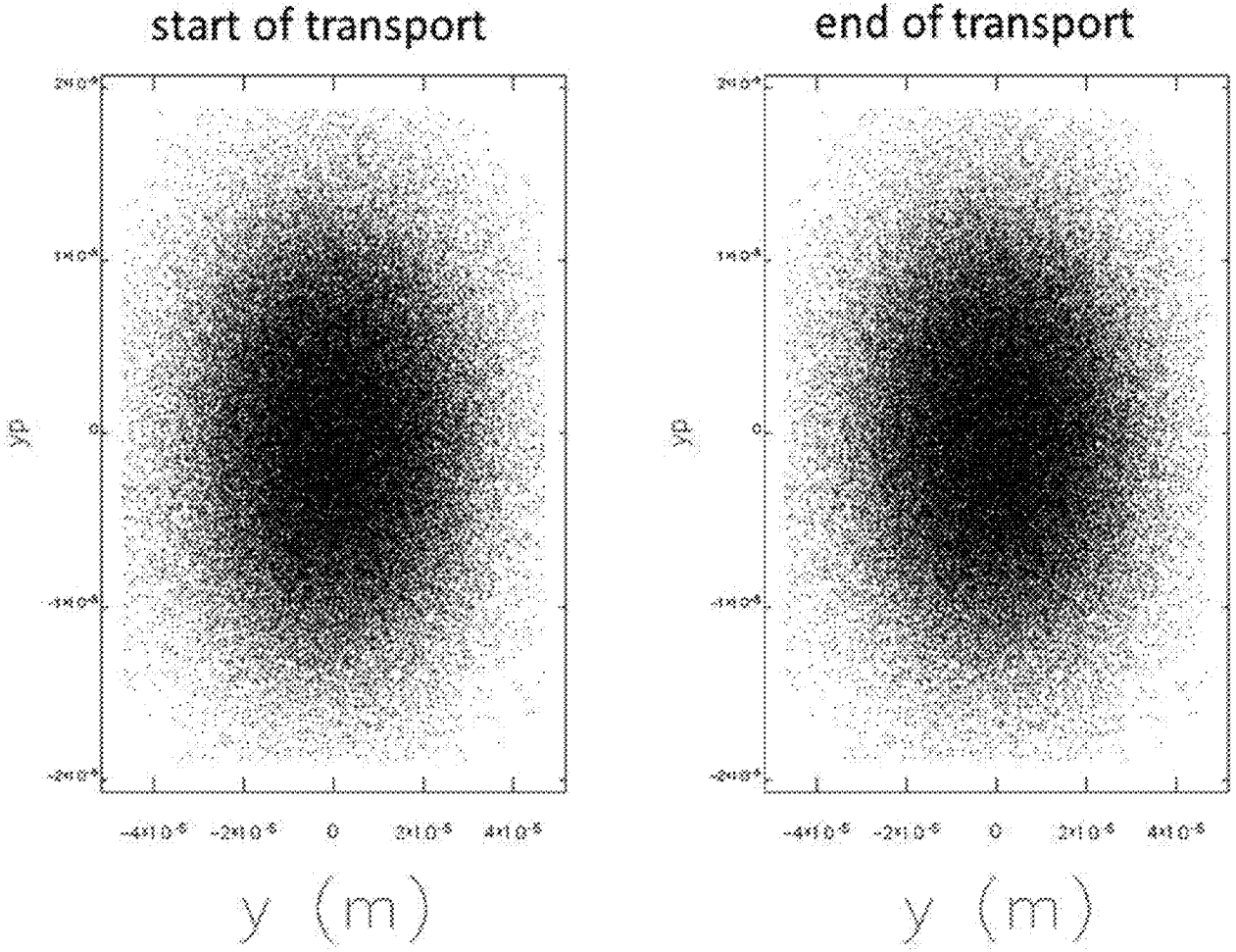
FIG. 8 presents the vertical phase space for a 300 pC beam with 0.25 mm-mrad initial rms normalized emittance and 33 keV-psec initial rms longitudinal emittance (at 3 psec rms bunch length) before (left) and after (right) transport through the example arc.
Figure 9:
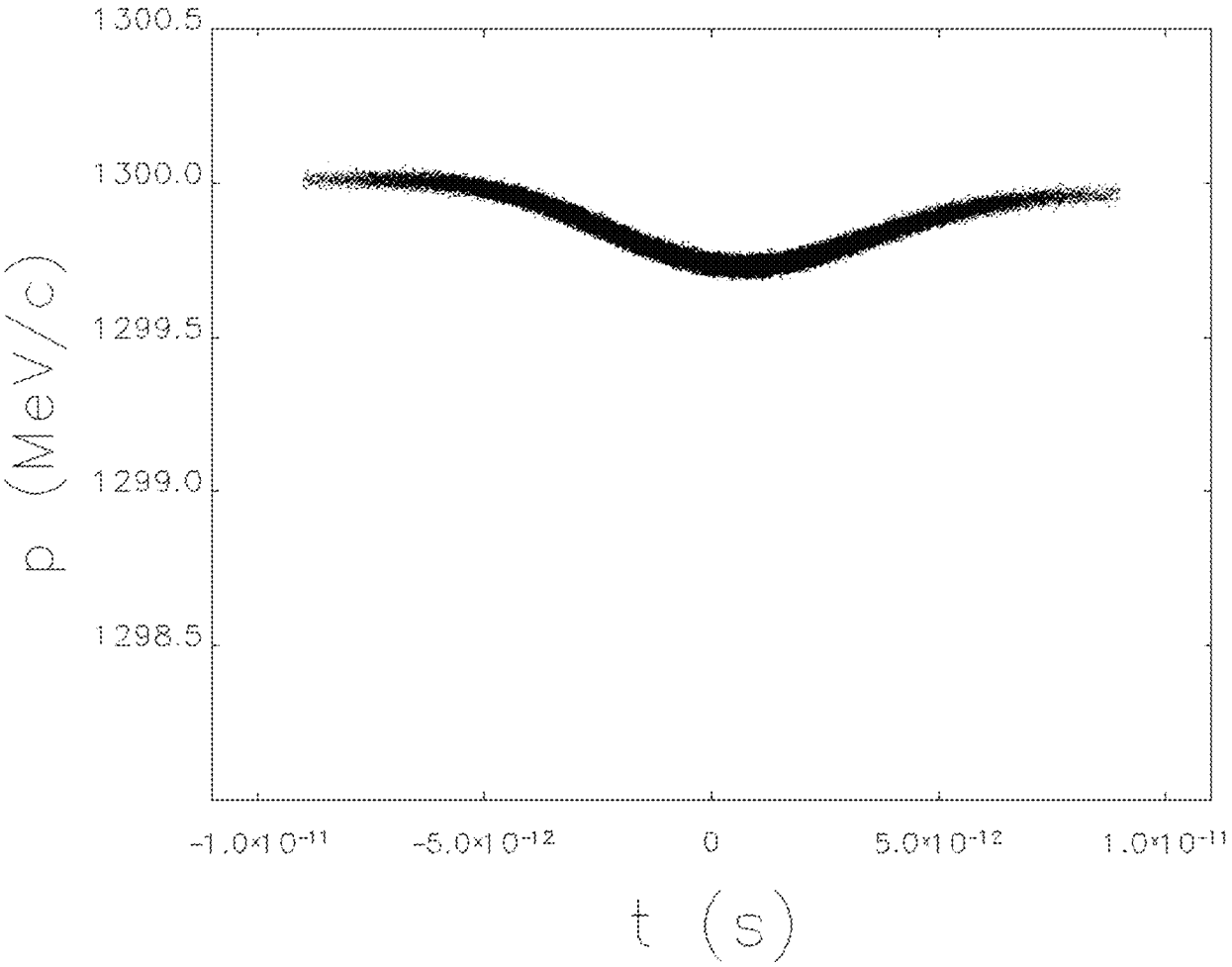
FIG. 9 presents the longitudinal phase space for a 300 pC beam with 0.25 mm-mrad initial rms normalized emittance and 33 keV-psec initial rms longitudinal emittance (at 3 psec rms bunch length) after transport through the example arc.

A primary purpose of this invention is to control beam quality degradation due to CSR. FIG. 5 thus summarizes a key measure of the effectiveness of the method—the simulated beam transverse emittance after 180° of bending at 1.3 GeV of a beam with initial normalized transverse emittance of 0.25 mm-mrad and longitudinal emittance of 33 keV-psec. This is done for an initial bunch length of 3 psec and bunch charges of 300, 400, and 500 pC. It is found that there is virtually no emittance growth at the end of the system, after the emittance compensation is complete. Simulation at 300 pC shows that the energy centroid drops by $4.45\times10^{-5}$, (FIG. 6), and simulations have shown that the loss remains linear in charge over a range of charges. Thus, although CSR actively extracts energy from the beam, the emittance does not grow significantly, demonstrating that CSR-like wake effects can be suppressed using this emittance compensation mechanism. The preservation of beam quality is made very clear by comparison of initial and final transverse phase space (FIGS. 7 and 8) and by the final longitudinal phase space (FIG. 9) from a simulation of a 300 pC bunch with initial transverse normalized emittance of 0.25 mm-mrad, longitudinal emittance of 33 keV-psec, and 3 psec bunch length. The transverse phase spaces are virtually unchanged, while the longitudinal phase space presents only a distortion due to the CSR wake, but shows neither growth overall nor evidence of the microbunching instability.

Figure 10:
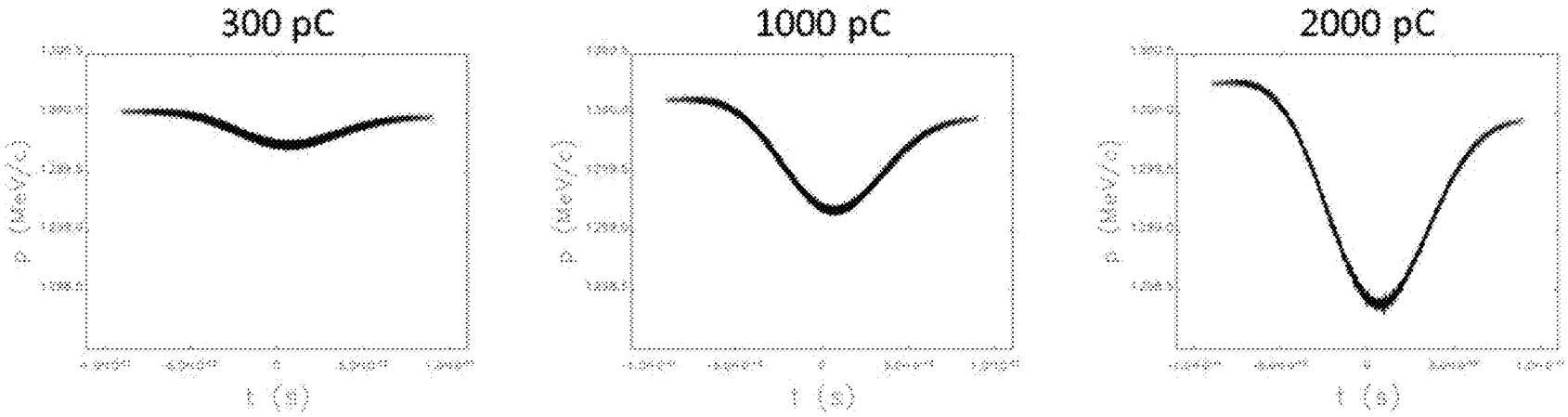
FIG. 10 presents the longitudinal phase space at 300 pC (left), 1000 pC (center), and 2000 pC (right) after transport through the example system. Microbunching effects become evident only at the very highest charge.

Simulations also indicate that microbunching effects are strongly suppressed. FIG. 10 presents results of a "quiet start" simulation of the 3 psec 300 pC bunch such as that shown in FIGS. 7-9. At 300 pC (left), the phase space is extremely regular and exhibits no evidence of microbunching whatsoever. At 1000 pC (center), only very subtle microbunching effects can be seen. Even at 2000 pC (right), only modest density modulations are apparent. An analysis of microbunching gain for this system indicates that the gain is very small.

A variety of other simulations and analyses all find that the use of this method in the example system (and other systems using this method) robustly controls CSR and provides suppression of microbunching effects. Thus, the present invention provides a method and apparatus for recirculation with control of synchrotron radiation. The apparatus includes a second-order achromatic and linearly isochronous recirculation arc that emittance-compensates CSR-induced beam quality degradation, is relatively ISR insensitive, allows non-linear compaction control, and avoids the μBI over a broad range of parameters typical of CW SRF-based linacs.

This method is appropriate for use in recirculated linac and ERL drivers for short wavelength FELs, electron sources for fundamental physics, and circulating cooler rings for electron cooling, as well as any other application requiring bending of a high-brightness electron beam.

What is claimed is:

1. A method of controlling incoherent synchrotron radiation (ISR) and coherent synchrotron radiation (CSR) in a high brightness electron beam comprising:

a. providing a super-periodic second order achromat line comprising a plurality of superperiods, wherein each superperiod in said plurality of superperiods includes a plurality of dipoles and quadrupoles and each superperiod is linearly achromatic and isochronous, the electron beam including a bend angle and a bend radius at each of said dipoles;

b. providing a tune for each superperiod, wherein each of the tunes provides the frequency of the transverse oscillation for the corresponding superperiod;

c. setting the tune for each superperiod to a rational fraction of an integer;

d. setting small individual bend angles to reduce driving terms due to dispersion and dispersive angle; and e. setting the bend radius of the electron beam at each of said dipoles to a value that will suppress ISR and will limit the radial dependence of CSR.

2. The method of claim 1, wherein said dipoles and quadrupoles are arranged in a superperiod structure and each of said dipoles includes a bend plane beam envelope value, said electron beam includes a betatron response, a beam angular divergence, a dispersion pattern, an angular error associated with a CSR event at a location of nonzero dispersive angle, and a microbunching instability derived from modulation in the longitudinal phase space distribution, wherein the method further comprises a) minimizing the bend plane beam envelope values in the dipoles to reduce betatron response to a CSR event at a dispersed location;

b) increasing the beam angular divergence, thus reducing the size of the angular error associated with a CSR event at a location of nonzero dispersive angle;

c) providing dispersion nodes in the dipoles to reduce response to CSR events; and d) limiting momentum compaction ($R_{56}$) modulation in order to reduce the microbunching instability (μBI).

* * * * *